US007256166B2

(12) United States Patent
Catalan et al.

(10) Patent No.: US 7,256,166 B2
(45) Date of Patent: Aug. 14, 2007

(54) LAUNDRY ARTICLES

(75) Inventors: Kemal V Catalan, Cincinnati, OH (US); Nicholas David Vetter, Cincinnati, OH (US); Rajan Keshav Panandiker, West Chester, OH (US); Yousef Georges Aouad, Cincinnati, OH (US); Dieter Boeckh, Limburgerhof (DE); Stefan Frenzel, Mannheim (DE); Cordula Mock-Knoblauch, Ludwigshafen (DE)

(73) Assignee: The Procter & Gamble Company, Cincinnati, OH (US)

( * ) Notice: Subject to any disclaimer, the term of this patent is extended or adjusted under 35 U.S.C. 154(b) by 281 days.

(21) Appl. No.: 10/345,679

(22) Filed: Jan. 16, 2003

(65) Prior Publication Data

US 2003/0139320 A1 Jul. 24, 2003

Related U.S. Application Data

(60) Provisional application No. 60/349,540, filed on Jan. 18, 2002.

(51) Int. Cl.
*C11D 17/06* (2006.01)
*C11D 3/37* (2006.01)
*D06L 1/12* (2006.01)

(52) U.S. Cl. ..... 510/295; 510/475; 510/499; 510/501; 442/121; 442/158; 442/164; 442/168; 8/137

(58) Field of Classification Search ..... 510/295, 510/475, 499, 501; 442/121, 158, 164, 168; 8/137
See application file for complete search history.

(56) References Cited

U.S. PATENT DOCUMENTS 3,414,459 A 12/1968 Wells
3,673,110 A 6/1972 Edwards
3,694,364 A 9/1972 Edwards
3,816,321 A 6/1974 Kleinschmidt
3,853,758 A 12/1974 Hurwitz et al.
3,905,863 A 9/1975 Ayers
3,929,135 A 12/1975 Thompson
3,944,694 A 3/1976 McQueary
3,956,556 A 5/1976 McQueary
3,974,025 A 8/1976 Ayers
4,007,300 A 2/1977 McQueary
4,012,540 A 3/1977 McQueary
4,065,257 A 12/1977 Coe et al.
4,118,525 A 10/1978 Jones
4,191,609 A 3/1980 Trokhan
4,199,464 A 4/1980 Cambre
4,254,139 A 3/1981 Hendrickson et al.
4,259,217 A 3/1981 Murphy
4,273,878 A 6/1981 Amick
4,324,246 A 4/1982 Mullane et al.
4,342,314 A 8/1982 Radel et al.
4,380,453 A 4/1983 Claiborne
4,463,045 A 7/1984 Ahr et al.
4,494,264 A 1/1985 Wattiez et al.
4,624,890 A 11/1986 Lloyd et al.
4,780,352 A 10/1988 Palumbo
4,830,784 A 5/1989 Meffert et al.
5,006,394 A 4/1991 Baird
5,374,334 A 12/1994 Sommese et al.
5,451,337 A 9/1995 Liu et al.
5,474,576 A 12/1995 Thoen et al.
5,478,489 A 12/1995 Fredj et al.
5,507,968 A 4/1996 Palaikis
5,520,875 A 5/1996 Wnuk et al.
5,534,182 A 7/1996 Kirk et al.
5,627,151 A 5/1997 Detering et al.
5,698,476 A * 12/1997 Johnson et al. ..... 442/121
5,773,545 A 6/1998 Schade et al.
5,804,662 A 9/1998 Schade et al.
5,830,844 A 11/1998 Detering et al.
5,881,412 A 3/1999 Ziskind
5,964,939 A 10/1999 Fox et al.
6,008,316 A 12/1999 Foster, Jr. et al.
6,140,293 A 10/2000 Lappas
6,277,810 B2 8/2001 Baines et al.
6,410,496 B1 6/2002 Masschelein et al.
6,833,336 B2 * 12/2004 Panandiker et al. ..... 442/121

(Continued)

FOREIGN PATENT DOCUMENTS

EP 0 325 944 A1 1/1989

(Continued)

OTHER PUBLICATIONS

Kirk-Othmer's Encyclopedia of Chemical Technology: vol. 14; pp. 737-783; 1995.

(Continued)

*Primary Examiner*—Brian Mruk
(74) *Attorney, Agent, or Firm*—Julia A. Glazer; Marianne Dressman; Kim William Zerby

(57) ABSTRACT

Laundry articles comprise a water-insoluble substrate and a particulate soil absorber comprising a crosslinked polyamide including units having a nucleophilic group. The particulate soil absorber is adhered to the water-insoluble substrate and is effective for inhibiting transfer or redeposition of particulate soil to items in a wash solution. Methods for making such articles comprise adhering a particulate soil absorber comprising a crosslinked polyamide including units having a nucleophilic group to the water-insoluble substrate.

13 Claims, No Drawings

U.S. PATENT DOCUMENTS

| | | | |
|---|---|---|---|
| 2002/0119721 | A1 | 8/2002 | Panandiker et al. |
| 2003/0118730 | A1 | 6/2003 | Aouad et al. |
| 2003/0158075 | A1 | 8/2003 | Panandiker et al. |

FOREIGN PATENT DOCUMENTS

| | | | | |
|---|---|---|---|---|
| EP | 0 341 205 | A2 | | 11/1989 |
| EP | 0 510 246 | A1 | | 10/1992 |
| EP | 0 634 486 | A1 | | 1/1995 |
| EP | 0 753 566 | A2 | | 1/1997 |
| EP | 0 779 358 | A2 | | 6/1997 |
| EP | 0 844 006 | A1 | | 5/1998 |
| EP | 844006 | | * | 5/1998 |
| EP | 1 020 513 | A2 | | 7/2000 |
| EP | 1 170 356 | | | 1/2002 |
| JP | 07-024951 | | | 7/1993 |
| JP | 1995024951 | | | 1/1995 |
| JP | 07-316590 | | | 12/1995 |
| WO | WO 95/03390 | | | 2/1995 |
| WO | WO 95/03765 | | | 2/1995 |
| WO | WO 96/00548 | | | 1/1996 |
| WO | WO 96/37598 | | | 11/1996 |
| WO | WO 97/42286 | | | 11/1997 |
| WO | WO 97/42290 | | | 11/1997 |
| WO | WO 98/29528 | | | 7/1998 |
| WO | WO 98/49259 | | | 11/1998 |
| WO | WO 99/14295 | | | 3/1999 |
| WO | WO 99/15614 | | | 4/1999 |
| WO | WO 00/35880 | | | 6/2000 |
| WO | WO 02/31246 | A2 | | 4/2002 |
| WO | WO 02/33040 | A1 | | 4/2002 |

OTHER PUBLICATIONS

Kirk-Othmer's Encyclopedia of Chemical Technology; vol. 14; pp. 737-783; 1995.

* cited by examiner

LAUNDRY ARTICLES

CROSS REFERENCE TO RELATED APPLICATIONS

This application claims priority under 35 U.S.C. § 119(e) to U.S. Provisional Application Ser. No. 60/349,540, filed Jan. 18, 2002.

FIELD OF THE INVENTION

The present invention is directed to new crosslinked polyamides for binding suspended particulate matter, water-insoluble articles for effective sequestration of particulate matter from aqueous suspensions and methods of making such articles. More specifically it is directed to laundry articles effective for inhibiting transfer or redeposition of particulate soil to items in a wash solution and methods for laundering items with such articles. More particularly, the present invention relates to laundry articles comprising a water-insoluble substrate and a particulate soil absorber comprising a crosslinked polyamide including units having a nucleophilic group wherein the particulate soil absorber is adhered to the water-insoluble substrate.

BACKGROUND OF THE INVENTION

One problem often encountered during normal laundering operations is the tendency of particulate soils to remain associated with items within the wash solution. In fact, even after their removal, particulate soils have been known to redeposit back onto the items during the wash cycle. Another problem associated with laundering operations involves the tendency of colored items to release dye into the wash solution. The extraneous dye is then transferred onto other items present in the wash cycle, thereby causing the newly dyed items to be permanently stained and/or color-altered. Another similar problem involves the premature fading of items within the wash solution as a result of undesirable dye removal.

One way of overcoming the problem of particulate soil and/or extraneous dye deposition onto items within the wash solution is to complex and/or adsorb the particulate soils and dyes before they can deposit on such items. In yet other approaches, these problems may be addressed by physically separating the various items within the wash solution by enclosing and/or encasing them within an envelope-like structure.

While the abovementioned techniques have proven useful for solving some laundering problems, developing improved yet consumer-friendly processes and/or products which address these problems has remained difficult. Accordingly, there is a desire for providing improved processes and/or products which solve these associated problems while simultaneously providing consumers with the quality and convenience they expect of such products.

SUMMARY OF THE INVENTION

It is therefore an object of the invention to provide means for binding suspended particulate matter that can be used i.e within laundry. In one embodiment the present invention is directed to water-insoluble articles for effective sequestration of particulate matter from aqueous suspensions and methods of making such articles. More specific it is therefore an object of the invention to provide new laundry articles to facilitate aqueous laundering. In one embodiment, the present invention is directed to laundry articles comprising (a) a water-insoluble substrate, and (b) a particulate soil absorber comprising a crosslinked polyamide including units having a nucleophilic group. The particulate soil absorber is adhered to the water-insoluble substrate and is effective for inhibiting transfer or redeposition of particulate soil to an item in a wash solution.

In a further embodiment, the invention is directed to methods for making laundry articles effective for inhibiting transfer or redeposition of particulate soil to an item in a wash solution. According to this embodiment, the methods comprise adhering a particulate soil absorber comprising a crosslinked polyamide including units having a nucleophilic group to a water-insoluble substrate.

In another embodiment, the invention is directed to methods of laundering an item. The methods comprise (a) adding a detergent composition to a wash solution, (b) adding a laundry article to the wash solution, and (c) laundering an item in the wash solution. The laundry article comprises a water-insoluble substrate, and a particulate soil absorber comprising a crosslinked polyamide including units having a nucleophilic group. The particulate soil absorber is adhered to the water-insoluble substrate and is effective for inhibiting transfer or redeposition of particulate soil to the item in the wash solution.

Accordingly, the present invention provides novel articles, more specifically laundry articles and methods for making and using such articles which overcome one or more disadvantages of the prior art. These and additional objects, advantages and novel features of the present invention will become apparent to those skilled in the art from the following detailed description, which is simply, by way of illustration, various modes contemplated for carrying out the invention. As will be realized, the invention is capable of other different obvious aspects all without departing from the invention. Accordingly, the specification is illustrative in nature and not restrictive.

DETAILED DESCRIPTION

The present invention is directed to water-insoluble articles for binding suspended matter and methods of making and using such articles. More specifically the present invention is directed to laundry articles and methods of making and using such laundry articles. More particularly, the laundry articles comprise a particulate soil absorber comprising a crosslinked polyamide including units having a nucleophilic group wherein the particulate soil absorber is adhered to a water-insoluble substrate. In exemplary embodiments, the laundry articles further comprise a dye absorber comprising a crosslinked polyamine. In still other exemplary embodiments, the laundry articles further comprise a dye transfer inhibitor.

Particulate Soil Absorber

The laundry articles of the present invention comprise a particulate soil absorber. As used herein, "particulate soil absorber" refers generally to a substance that has a high affinity for extraneous, free-flowing particulate soils and/or clay or dirt materials present within an aqueous wash solution. More particularly, a particulate soil absorber is a substance that scavenges soils from the wash solution of a laundering operation and is thus utilized for its properties as a particulate soil pick-up material. Thus, the particulate soil absorbers are effective for inhibiting transfer or redeposition of particulate soil and/or other dirt related materials to items in the wash solution. As used herein, "soil" is intended to encompass any type of foreign substance and/or material not normally associated with a given item, such as sand, dirt, clay, soil, grease, and other like materials. As used herein, "inhibiting" refers generally to a decrease and/or reduction in rate and is not intended to be interpreted as requiring a complete elimination, although certain embodiments may provide such complete elimination.

The particulate soil absorber comprises a crosslinked polyamide polymer including units having a nucleophilic group. As used herein, "polyamide polymer" refers generally to a polymer which may be natural or synthetic and has amide groups and/or amide linkages (—CONH—), either pendant to or incorporated into its molecular chain. As used herein, "nucleophilic group" refers generally to a group or moiety that donates a pair of electrons to form a covalent bond. The nucleophilic group is generally selected from the group consisting of OH, primary amino groups, secondary amino groups, primary carboxy groups, secondary carboxy groups and mixtures thereof. In one embodiment, the nucleophilic group comprises primary amine functionality. The primary amine functionality acts as a nucleophile and attacks electrophilic regions of the crosslinking agent. As used herein, "crosslinked" and/or "crosslinking" refers generally to a chemical process in which two chains of polymeric molecules are attached by bridges composed of an element, a group or a compound, which join certain carbon atoms of the chains by primary chemical bonds.

Any suitable level of the particulate soil absorber may be adhered to the water-insoluble substrate. As used herein, "adhered" refers generally to a condition wherein the soil absorber is associated and/or attached to the substrate. In one embodiment, the laundry articles comprise from about 0.29 to about 75 weight percent of a particulate soil absorber, based on the total weight of the particulate soil absorber and the water-insoluble substrate. In more specific embodiments, the particulate soil absorber is present in the laundry articles in an amount of from about 2 to about 23 weight percent, more specifically from about 5 to about 17 weight percent.

The crosslinked polyamides of the present invention may be adhered to the water-insoluble substrate by any suitable means appropriate for laundering operations. More particularly, in one embodiment, the crosslinked polyamides are covalently bonded to the water-insoluble substrate by means of a linking group and/or crosslinking agent (coupling agent). In an alternate embodiment, the crosslinked polyamide is merely adsorbed on the water-insoluble substrate, as the crosslinking reaction takes place at the substrate surface. Upon such adherence, the crosslinked polymer acts as a dirt scavenger during the laundering process, thereby attracting and trapping particulate soils from the wash solution to the water-insoluble substrate surface.

In still other exemplary embodiments, the nature of the relationship by which the particulate soil absorber is associated with the water-insoluble substrate includes, but is not limited to, binding, adsorption or absorption; hydrogen bonding; electrostatic forces such as ion/ion or ion/dipole interactions; intercalation, incorporation or insertion therein; chemical or physical bonding, etc.; or any suitable combination thereof. The particulate soil absorber may be introduced into or onto the water-insoluble substrate by any of a variety of wet or dry techniques which include, but are not limited to, direct chemical reaction; coupling via an intermediary; precipitation; melting; entanglement with the structure; temperature, pressure or ultrasound; the use of electromagnetic energy further characterized as infrared (IR), ultraviolet (UV), microwave or plasma; or any combination thereof.

In a specific embodiment, the polyamides of the present laundry articles are selected from the group consisting of nonionic polyamides and cationic polyamides. In exemplary embodiments, the particulate soil absorber comprises at least one crosslinked polymer containing polymerized units of an N-vinyl-$C_1$-$C_3$-carboxamide and nucleophilic groups and is formed with a crosslinking agent comprising at least two electrophilic groups. More particularly, in specific embodiments, polymers of partially hydrolyzed poly-N-vinyl-$C_1$-$C_3$-carboxamides or copolymers of partially hydrolyzed N-vinyl-$C_1$-$C_3$-carboxamides with other ethylenically unsaturated monomers may be employed. The hydrolyzed units may contain the nucleophilic groups. Poly-N-vinyl-$C_1$-$C_3$-carboxamides may have a degree of hydrolysis of from about 1 to about 90 mol %, more specifically from about 5 to about 75 mol %, even more specifically of from about 10 to about 50 mol %. Examples of such polymers are represented by the following formulas (1)-(2):

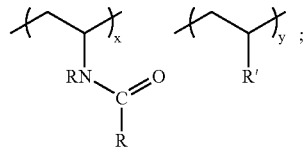

(1)

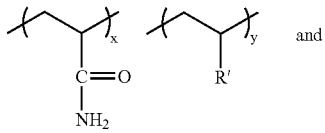

and (2)

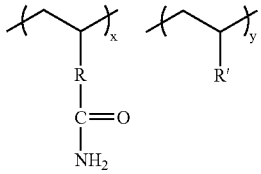

(3)

wherein y represents the molar amount of the nucleophilic hydrolyzed unit; each R is selected from the group consisting of: H, $CH_3$, $CH_2CH_3$, $CH_2CH_2CH_3$, $CH_2CH_2CH_2CH_3$, $CH_2OR$, $CH_2CH_2OR$, $CH_2CH_2CH_2OR$; and each R' is a nucleophilic moiety selected from the group consisting of: —$NH_2$; —$RNH_2$; —NRH; —RNRH; —$CO_2H$; —$RCO_2H$; —$CONH_2$; —$RCONH_2$;

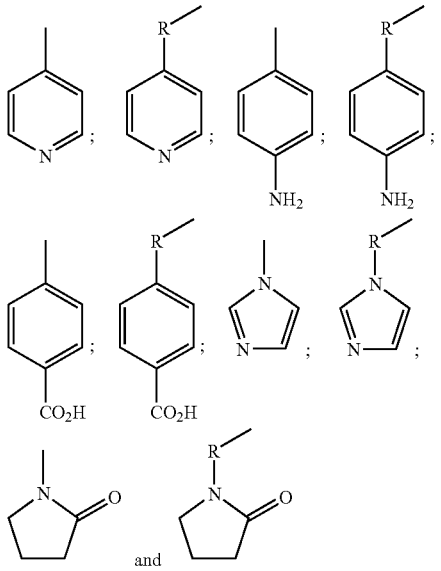

Additionally, the weight average molecular weight of such polymers is from about 10,000 to 5,000,000 D, from about 25,000 to about 1,000,000 D, or from about 40,000 to about 500,000 D.

In a more specific embodiment according to the present invention, the particulate soil absorber comprises a partially hydrolyzed poly-N-vinylformamide of the formula:

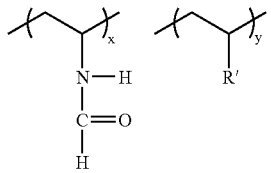

wherein x, y and R' are defined as described above.

Suitable monomers for preparing such polymers include, but are not limited to, N-vinylformamide, N-vinyl-N-methylformamide, N-vinylacetamide, N-vinyl-N-methylacetamide, N-vinylpropionamide and N-vinyl-N-methylpropionamide. The monomers can be polymerized alone, in mixtures with one another, or together with one or more additional monoethylenically unsaturated monomers.

The partially hydrolyzed polymers and copolymers may be formed by hydrolyzing a poly-N-vinyl-$C_1$-$C_3$-carboxamide polymer or copolymer using any conventional hydrolysis reaction known in the art to provide the desired nucleophilic R' group.

In one embodiment, copolymers of the present invention may be formed by the polymerization of: a) 40 to 99% by weight of at least one N-vinyl-$C_1$-$C_3$-carboxamide; b) 1 to 60% of monoethylenically unsaturated comonomers containing at least one nucleophilic group; c) 0 to 60% by weight of a modifying copolymerizable monoethylenically unsaturated nonionic or cationic monomer; d) 0 to 20% by weight of other modifying monoethylenically unsaturated monomers such as, but not limited to, carboxylic acids, sulfonic acids and phoshonic acids, the alkali metal salts and the anhydrides thereof; and e) 0 to 5% by weight of polyethylenically unsaturated monomers.

Suitable comonomers (b) containing at least one nucleophilic group comprise N-vinylimidazole, N-vinyl-2-methylimidazole, N-vinyl-4-methyl-imidazole, N-vinyl-5-methylimidazole, and esters of ethylenically unsaturated carboxylic acids with dialkylaminoalkylalcohols, such as dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate, dimethylaminobutyl acrylate and diethylaminobutyl acrylate. Other suitable comonomers (b) include amides of ethylenically unsaturated carboxylic acids with dialkylaminoalkylamines, such as, dimethylaminoethyl acrylamide, dimethylaminoethyl methacrylamide, diethylaminoethyl acrylamide, diethylaminoethyl methacrylamide, dimethylaminopropyl acrylamide, dimethylaminopropyl methacrylamide, diethylaminopropyl acrylamide, dimethylaminobutyl acrylamide and diethylaminobutyl acrylamide.

It has been determined that vinylimidazoles, basic acrylates and basic acrylamides can be used in the form of free bases, salts with mineral acids, such as hydrochloric acid, sulfuric acid or nitric acid, and salts with organic acids, such as formic acid, acetic acid, propionic acid or sulfonic acids.

Suitable monoethylenically unsaturated monomers (c) include all other monoethylenically unsaturated nonionic or cationic monomers. Examples of such include, vinyl esters of saturated $C_1$-$C_6$-carboxylic acids, such as vinyl formate, vinyl acetate, vinyl propionate and vinyl butyrate, and vinyl ethers, such as $C_1$-$C_6$-alkyl vinyl ethers, such as methyl vinyl ether and ethyl vinyl ether, esters, amides and nitrites of monoethylenically unsaturated $C_3$-$C_6$-carboxylic acids, such as esters, amides and nitrites of acrylic acid, methacrylic acid, maleic acid, crotonic acid, itaconic acid and vinyl acetic acid, such as methyl acrylate, methyl methacrylate, ethyl acrylate and ethyl methacrylate, n-butylacrylate, t-butylacrylate, 2-ethylhexylacrylate, laurylacrylate, acrylamide, methacrylamide, N-methylacrylamide, N-isopropylacrylamide, N-octylacrylamide, N-vinylpyrrolidone, N-vinylcaprolactame, N-vinyloxazolidine, acrylonitrile and methacrylonitrile.

Additional monoethylenically unsaturated monomers (c) include esters of monoethylenically unsaturated $C_3$-$C_6$-carboxylic acids which are derived from glycols of polyalkylene glycols and wherein only one hydroxyl group is esterified. Suitable examples include hydroxyethyl acrylate, hydroxypropyl acrylate, hydroxybutyl acrylate, hydroxyethyl methacrylate, hydroxypropyl methacrylate, hydroxybutyl methacrylate and acrylic monoesters of polyalkylene glycols having a molar mass of from about 500 to about 10,000 D, N-vinylpyrrolidone, N-vinylcaprolactame, N-vinyloxazolidine, styrene, ethylene, propylene, butylene, isobutylene, diisobutene and butadiene. Additional monoethylenically unsaturated cationic comonomers (c) include the quaternized derivatives of monomers (b) wherein quantemization is done with $C_1$-$C_{18}$-alkylating agents, such as $C_1$-$C_{18}$-alkylhalogenides, $C_1$- or $C_2$-dialkylsulfates or benzylhalogenides and diallyldialkylammonium halides, such as diallyldimethylammonium chloride.

Suitable anionic monoethylenically unsaturated monomers (d) include monoethylenically unsaturated $C_3$-$C_6$-carboxylic acids, such as acrylic acid, methacrylic acid, maleic acid, crotonic acid, itaconic acid and vinyl acetic acid; monoethylenically unsaturated sulfonic acids, such as vinylsulfonic acid and acrylamidopropanesulfonic acid; and monoethylenically unsaturated phoshonic acids such as vinylphosphonic acid and the alkali metal salts thereof.

Suitable polyethylenically unsaturated monomers (e) are monomers which contain at least 2 monoethylenically unsaturated, non-conjugated double bonds and are usually used as crosslinking agents for polymerization reactions, such as acrylic esters, methacrylic esters, allyl ethers and vinyl ethers of at least dihydric alcohols, such as the diacrylates or dimethacrylates of $C_2$-$C_6$-diols, polyethylene glycols with 2-15 ethylene glycol units, and polypropylene glycols with 2-5 propylene glycol units. Other suitable monomers (e) include di(acrylic amides) or di(methacrylic)amides of $C_2$-$C_8$-diamines, methylenebisacrylamide, N,N'-divinylurea or divinylstyrene.

In another exemplary embodiment, the particulate soil absorbers comprise at least one crosslinked polymer containing polymerized units of an N-vinyl-$C_1$-$C_3$-carboxamide formed by reacting a polymer containing an electrophilic group with a crosslinking agent containing at least two nucleophilic groups.

In a more specific embodiment, polymers containing electrophilic groups according to the present invention comprise a copolymer of N-vinyl-$C_1$-$C_3$-carboxamide which is formed by the polymerization of: a) 40 to 99.5% by weight of N-vinyl-$C_1$-$C_3$-carboxamide; b) 0.5 to 50% by weight of an ester of a monoethylenically unsaturated carboxylic acid with $C_1$-$C_4$-alcohols or 0.5 to 20% by weight of an anhydride of a monoethylenically unsaturated dicarboxylic acid; c) 0 to 60% by weight of other copolymerizable nonionic or cationic monoethylenically unsaturated monomers; and d) 0 to 20% by weight of other copolymerizable anionic monoethylenically unsaturated monomers. Suitable crosslinking agents are polyamines with at least two primary, secondary or tertiary amino groups.

The typical molar mass molecular weight (Me) of the above polymers which contain electrophilic groups is from about 10,000 to about 5,000,000 D, from about 25,000 to about 1,000,000 D or from about 40,000 to about 500,000 D.

In another embodiment, the particulate soil absorber comprises at least one crosslinked copolymer containing polymerized units of an N-vinyl-$C_1$-$C_3$-carboxamide together with at least one polyethylenically unsaturated monomer and at least one initiator. According to this embodiment, the polymers may optionally be reacted in the presence of further ethylenically unsaturated monomers. Suitable polymers according to this embodiment are prepared by radical polymerization of mixtures of ethylenically unsaturated monomers containing: a) 5 to 99.5% by weight of N-vinyl-$C_1$-$C_3$-carboxamides; b) 0 to 80% by weight of other copolymerizable monoethylenically unsaturated monomers; c) 0.005 to 20% by weight of at least one polyethylenically unsaturated monomer, using 0.005 to 10% by weight of at least one thermal or photochemical polymerization initiator.

Typical photochemical initiators known within the art and suitable for the present invention include, but are not limited to, aromatic ketones, quinones, ethers and nitro compounds, such as benzoquinone, phenanthrenequinone, naphthoquinone, diisopropylphenanthrenequinone, benzoisobutyl ether, benzoin, benzoin methyl ether, furoin butyl ether, Michler's ketone, Michler's thioketone, fluorenone, trinitrofluorenone and β-benzoylaminonaphthalene.

Polymers of the present invention may optionally comprise additional conventional ingredients such as, but not limited to, polymerization regulators, thickeners, emulsifiers, wetting agents or combinations thereof. Such optional ingredients are typically included within the present polymers at a level of from about 0 to about 20% by weight of the polymer.

In one embodiment according to the present invention, the crosslinking agents contain at least 2 electrophilic groups. Such crosslinking agents include, but are not limited to, oligoglycidyl ethers, oligohalohydrins, halohydrins, alkylene dihalogenides, oligoisocyanates, polyamine-epichlorhydrin or polyamidoamine-epichlorohydrine resins with free acetidinium, glycidyl or halohydrine-groups. Preferred crosslinking agents according to this embodiment comprise bis- or trisglycidyl ethers and di- or trichlorohydrins of alkoxylated polyhydric alcohols and epichlorohydrin adducts of polyamines, polyethyleneiminies, polyamidoamines and amine-aldehyde resins.

In a specific embodiment according to the present invention, the particulate soil absorber comprises a crosslinking agent selected from the group consisting of epihalohydrins, polyhalohydrins, bishalohydrins, alkylene dihalides, alkylene trihalides, bisepoxides, trisepoxides, tetraepoxides and mixtures thereof. In another specific embodiment the particulate soil absorber comprises a crosslinking agent selected from the group consisting of epichlorohydrins, polychlorohydrins, bishalohydrins of polyalkylene diols, bishalohydrins of polyalkylene glycols, bishalohydrins of polytetrahydrofurans, polyisocyanates, polyamidoamine/epichlorohydrine resins, amine-aldehyde resins, polyglycidylethers, poly(meth)acrylesters and mixtures thereof. In still other embodiments, the particulate soil absorber comprises a crosslinking agent selected from the group consisting of polyamide-epichlorohydrins, trimethylolpropane tris-glycidyl ethers, poly(meth)acrylesters of polyhydroxy compounds, water-soluble polyamidoamine/epichlorohydrin resins, water-soluble polyglycidylethers, polychlorohydrins of alkoxylated polyols and mixtures thereof.

In forming the laundry articles of the present invention, the polymer and the crosslinking agent are used in such a ratio that an effective crosslinking reaction takes place on the surface of the water-insoluble substrate. Typically, the amount of crosslinking agent used, based on the weight of the polymer, is from about 1 to about 300% by weight, from about 5 to about 150% by weight, or from about 10 to about 100% by weight.

In an exemplary embodiment, the laundry articles according to the present invention are prepared by applying or impregnating the substrates with the polymer and crosslinking agent, followed by heating. Specifically, aqueous solutions comprising from about 1 to about 90% by weight, from about 5 to about 80% by weight or from about 20 to about 70% by weight of the polymer and from about 1 to 100% by weight, from about 5 to about 85% by weight or from about 20 to about 70% by weight of the crosslinking agent are used, based on the weight of substrate.

The crosslinking reactions of the present invention are typically conducted at a pH of from about 5 to about 12, from about 6 to about 11, or from about 7 to about 10, and at a temperature of from about 90° C. to about 250° C., from about 110° C. to about 200° C., or from about 130° C. to about 180° C.

The materials may be applied to the water-insoluble substrates by impregnation, spraying, printing or knife-coating. Optionally, a padding procedure may also be used during application of the materials. The components may be applied as a finished blend or as separate solutions. Furthermore, the pH can be adjusted in the initial solutions, in the mixture or by applying an acid or base to the substrate laden with other components. The heat for the crosslinking reaction can be provided batchwise or continuously in a furnace, a microwave oven or by a hot stream of gas.

Water-Insoluble Substrate

The laundry articles of the present invention comprise a water-insoluble substrate. More particularly, as used herein, "water-insoluble substrate" refers generally to any type of water-insoluble material, whether natural or synthetic, which is capable of being placed in an aqueous solution and serving as a support matrix and/or carrier vehicle. As used herein, "wash solution" refers generally to an aqueous solution useful for laundering operations. The water-insoluble substrates according to the present invention are capable of adsorbing and/or bonding the particulate soil absorber to their surface, particularly by either a physical means and/or a grafting means. Further to its function as an adsorption surface, the water-insoluble substrate is also capable of providing a sufficient surface area upon which the particulate soil absorber is accessible to the wash solution in which the laundry article is to be used.

The water-insoluble substrate serves as both a delivery device and a visual indicator device. More particularly, as a delivery device, the water-insoluble substrate is able to introduce the particulate soil absorber and optionally other various laundry components, for example dye absorbers and dye transfer inhibitors, into the wash solution. The particulate soil absorber remains adhered to the water-insoluble substrate. In further embodiments, additional components such as dye absorbers also remain adhered to the substrate. In contrast, other optional components, for example dye transfer inhibitors, are releasably attached to the water-insoluble substrate and therefore may be essentially delivered from the water-insoluble substrate to the surrounding wash solution. As a visual indicator device, the water-insoluble substrate further acts as a substrate upon which components, such as the particulate soil absorber, dye absorber and dye transfer inhibitor, can impart a visual signal that some activity has taken place.

Materials suitable for formulating the water-insoluble substrates of the present, invention, include but are not limited to, cellulosic fibers (woven or nonwoven), non-cellulosic fibers (woven or nonwoven), modified cellulosic fibers (woven or nonwoven), zeolites, starches, modified starches, and mixtures thereof. In an exemplary embodiment, the water-insoluble substrate of the present invention is a fibrous substrate, preferably a cellulosic fibrous material. According to this embodiment, useful cellulosic materials capable of serving as the water-insoluble substrate include, but are not limited to, woven and non-woven forms of wood pulp, rayon and cotton. Synthetic polymeric materials such as polyester, polyethylene, polypropylene and polyurethane may also be used as the water-insoluble substrate alone or in combination with other water-insoluble substrates as additives to improve fabric wash strength under standard washing conditions. Additionally, it has been further determined that acetates are also suitable as the water-insoluble substrate, particularly monoacetates.

In a specific embodiment according to the present invention, the water-insoluble substrate is tissue paper made with northern softwood Kraft pulp and having a weight of approximately 40 grams per square meter (gsm). Other specific water-insoluble substrates, include hydroentangled wet laid nonwovens having a weight of approximately 60 gsm. Examples of such hydroentangled wet laid nonwovens include, but are not limited to, products sold under the trade name Hydraspun® (Dexter Corp., Windsor Locks, Conn.). Still other water-insoluble substrates useful according to the present invention include air-laid nonwovens comprising 72% wood pulp, 25% bicomponent fibers, and 4% latex and having a weight of approximately 100 gsm. Examples of such air-laid nonwovens include, but are not limited to, products sold under the trade name Visorb (Buckeye Technologies, Memphis, Tenn.).

The exterior color of the water-insoluble substrates according to the present invention is not intended to be limiting, as such substrates may exhibit any known color or combination of colors. In specific embodiments, however, it may be beneficial for the water-insoluble substrate to exhibit a light pigment based color so that dyes and/or dirt particles collected on its surface as a result of the wash cycle can be seen by the user and/or consumer. Additionally, the water-insoluble substrates may comprise one layer or multiple layers which are formed in any combination of materials exhibiting these desired properties. The water-insoluble substrate may also be water permeable if desired to allow the wash solution to pass through its structure to enhance absorption of fugitive dyes by the dye absorber.

Since almost any water-insoluble material may be used as the substrate, some further considerations may include durability, handfeel, processability, and cost. Other desirable properties include the substrate not producing lint, not falling apart or balling up. Furthermore, it may be desirable for the substrate to be heat resistant up to temperatures employed in typical wash conditions and able to survive drying within a conventional clothes dryer without producing any ill effects.

In exemplary embodiments, the water-insoluble substrate comprises a fiber or filament, wherein the fiber or filament is incorporated in woven or non-woven form to generate a sheet or sheet-like material. Without being limited herein, however, those skilled in the art will appreciate that the water-insoluble substrate may exist in virtually any form suitable for laundering operations, as the form and composition of the water-insoluble substrate are not intended to be limiting herein.

Optional Components

In exemplary embodiments according to the present invention, the laundry articles may further comprise a dye absorber, for example, comprising a crosslinked polyamine, adhered to the water-insoluble substrate. As used herein, "dye absorber" refers generally to any substance that has a high tinctorial affinity for extraneous, free-flowing dyes and/or colorants in an aqueous wash solution. More particularly, a dye absorber is a substance that scavenges dyes from the surrounding aqueous wash solution and is employed for its properties as a dye take-up substance.

The nature of the relationship by which the dye absorber is associated with the water-insoluble substrate includes, but is not limited to, binding, adsorption or absorption; hydrogen bonding; electrostatic forces such as ion/ion or ion/dipole interactions; intercalation, incorporation or insertion therein; chemical or physical bonding, etc.; or any suitable combination thereof. The dye absorber may be introduced into or onto the support matrix by any of a variety of wet or dry techniques which include, but are not limited to, direct chemical reaction; coupling via an intermediary; precipitation; melting; entanglement with the structure; impregnation; techniques employing pH, temperature, pressure or ultrasound; the use of electromagnetic energy further characterized as infrared (IR), ultraviolet (UV), microwave or plasma; or any combination thereof.

Suitable dye absorbers for the laundry articles of the present invention include polymeric amine dye absorbers that are made substantially insoluble through a crosslinking process. According to this embodiment, the polymers may be crosslinked prior to their introduction to the water-insoluble substrate, simultaneously with their introduction to the substrate or after their introduction to the substrate. Some polymers include, but are not limited to, crosslinked polyvinyl pyrrolidones; crosslinked polyvinyl pyridines and derivatives thereof, including quaternized polyvinyl pyridine carboxylate polymers as described in International Application WO 00/35880, which is incorporated herein by reference. Other polymers include crosslinked polyvinyl-N-oxides and crosslinked polyallylamines; homopolymers and copolymers containing the monomer unit:

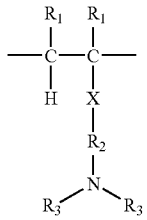

wherein: $R_1$ is selected from H, $C_1$-$C_4$ alkyl and mixtures thereof; $R_2$ is selected from $C_2$-$C_6$ alkylene, hydroxyalkylene, and mixtures thereof; $R_3$ is selected from H, $C_1$-$C_4$ alkyl, $C_7$-$C_9$ alkylaryl, $C_2$-$C_4$ hydroxyalkyl, and mixtures thereof; and x is

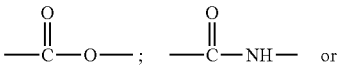

or mixtures thereof. Still other polymers include crosslinked homopolymers, copolymers and terpolymers containing the monomer unit:

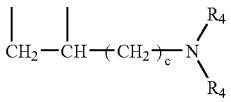

wherein c=0 or 1; and $R_4$ is selected from the group consisting of H, $C_1$-$C_4$ alkyl, hydroxylalkyl, and mixtures thereof.

In addition, crosslinked anion exchange resins made from water insoluble monoethylenically unsaturated monomers such as styrene, butadiene and acrylic esters and, as a crosslinker a small portion of polyethylenically unsaturated monomers such as divinyl naphthalene, diallyl phthalate, may be used as dye absorbers. Anion exchange resins have been described in Charles Dickert in Kirk-Othmer's Encyclopedia of Chemical Technology: Volume 14, pages 737-783. (1995) John Wiley and Son. Examples of anion exchange resins have also been described in U.S. Pat. No. 3,853,758, GB 1,335,591 and U.S. Pat. No. 4,273,878, all of which are incorporated herein by reference.

In one exemplary embodiment according to the present invention, the dye absorber of the laundry article is formed by copolymerizing a bifunctional vinyl or acrylic monomer comprising an amine group with a monomer selected from the group consisting of polyfunctional vinyl compounds, polyfunctional acrylic compounds and mixtures thereof.

In further exemplary embodiments according to the present invention, the laundry article comprises a dye transfer inhibitor releasably attached and/or associated with the water-insoluble substrate. The dye transfer inhibitor may be employed as a counterpart to the dye absorber and performs a complementary function. More particularly, while the dye absorber is typically introduced into the wash solution by and remains associated with the water-insoluble substrate, the dye transfer inhibitor is releasably attached and/or associated with the substrate. As used herein, "dye transfer inhibitor" generally refers to any solubilized or dispersed substance which prevents the undesirable discoloration of items in a wash solution by extraneous or free flowing dyes that have been given up by items being laundered. The dye transfer inhibitor can achieve this goal by a variety of techniques including, but not limited to, suspending the dye in the wash solution; solubilizing the dye in such a manner that it is unavailable for redeposition onto a wash item; reducing the affinity of the dye for a textile substrate; fixing the dye to the fabric; trapping the dye; precipitating out the dye; etc. Alternatively, the dye transfer inhibitor may also adsorb, absorb, or otherwise become associated with any extraneous dyes present in the wash solution in a manner similar to the functioning of the dye absorber.

Many different materials can be used as dye transfer inhibitors, including, but not limited to, polymers, enzymes, bleaches (with or without bleaching aids and/or bleaching activators), inclusion compounds, minerals, nonionic and conventional aqueous thickeners, systems comprising combinations of those listed above, and combinations thereof.

Methods for Making and Using Laundry Articles

The present invention is also directed to methods for making laundry articles which are effective for inhibiting the transfer or redeposition of particulate soil to items within a wash solution. In one embodiment, the methods comprise adhering a particulate soil absorber comprising a crosslinked polyamide including units derived from a nucleophilic monomer to a water-insoluble substrate. According to this embodiment, the step of adhering the particulate soil absorber to the water-insoluble substrate comprises crosslinking a polyamide at the surface of the water-insoluble substrate.

The methods for making laundry articles according to the present may also comprise the step of adhering a dye absorber comprising a crosslinked polyamine to the water-insoluble substrate. Furthermore, the methods may also comprise the step of releasably associating a dye transfer inhibitor to the water-insoluble substrate.

The laundry articles of the present invention may be used in methods of laundering items in a wash solution. In one exemplary embodiment, a method of laundering an item comprises the steps of adding a detergent composition to a wash solution, adding a laundry article to the wash solution, and laundering an item in the wash solution. According to this embodiment, the laundry article comprises a water-insoluble substrate and a particulate soil absorber comprising a crosslinked polyamide including units derived from a nucleophilic monomer and adhered to the water-insoluble substrate.

Advantages and improvements of the articles and methods of the present invention are demonstrated in the following examples. The examples are illustrative only and are not intended to limit or preclude other embodiments of the invention.

EXAMPLE 1

In this example a laundry article of the present invention is prepared. A mixture for formulating the particulate soil absorber comprising a crosslinked polyamide includes 34.5% copolymer of 80% polyvinylformamide with a K-value of 68.9, and with 20 mol % of the formamide-groups hydrolyzed (available from BASF AG, Germany); 60% poly(aminoamide) epichlorohydrin resin (PAE—available from Hercules, Inc., Wilmington, Del. under the trade name Kymene® 557H); and water to make 100% is prepared. The mixture is padded on a water-insoluble substrate, comprising a Visorb X622 nonwoven structure (basis weight 100 gsm, and available from Buckeye Technologies, Memphis, Tenn.) using a Werner Mathis 2 roll Padding Machine, Model HVF. The nip pressure is set to achieve a pickup level of about 120%. The water-insoluble substrate is then dried and cured in a convection oven at 250° F. for 20 minutes to effectuate a crosslinking reaction.

The dry sheet weight of the composition is 0.2 g polyvinylformamide and 0.3 g PAE resin for a total sheet weight of 1.7 g.

EXAMPLE 2

In this example a laundry article of the present invention is prepared. A mixture for formulating the particulate soil absorber comprising a crosslinked polyamide include 34.5% copolymer of 80% polyvinylformamide with a K-value of 68.9, and with 20 mol % of the formamide-groups hydrolyzed (available from BASF AG, Germany); 7.5% epichlorohydrin (available from Aldrich); and water to make 100% is prepared. The mixture is padded on a water-insoluble substrate, comprising a Visorb X622 nonwoven structure and the water-insoluble substrate is then dried and cured using the procedures described in Example 1.

The dry sheet weight of the composition is 0.2 g polyvinylformamide and 0.3 g epicholorhydrin for a total sheet weight of 1.7 g.

EXAMPLE 3

In this example a laundry article of the present invention is prepared. A mixture for formulating the particulate soil absorber comprising a crosslinked polyamide include 34.5% copolymer of 80% polyvinylformamide with a K-value of 68.9, and with 20 mol % of the formamide-groups hydrolyzed (available from BASF AG, Germany); 7.5% epichlorohydrin (available from Aldrich); 35.0% polyvinyl pyrrolidone co-vinyl imidazole (available from BASF AG, Germany and sold under the trade name Sokolan® HP 56); and water to make 100%. The mixture is padded on a water-insoluble substrate, comprising a Visorb X622 nonwoven structure and the water-insoluble substrate is then dried and cured using the procedures described in Example 1.

The dry sheet weight of the composition is 0.2 g polyvinylformamide, 0.3 g epicholorhydrin and 0.7 g polyvinyl pyrrolidone co-vinyl imidazole for a total sheet weight of 2.4 g.

The examples and specific embodiments set forth herein are for illustrative purposes only and are not intended to limit the scope of the articles and methods of the invention. Additional articles and methods within the scope of the claimed invention will be apparent to one of ordinary skill in the art in view of the teachings set forth herein.

What is claimed is:

1. A laundry article comprising:

(a) a water-insoluble substrate; and (b) a particulate soil absorber wherein said absorber is a substance that has an affinity for extraneous, free-flowing particulate soils and/or clay or dirt materials present within an aqueous wash solution and is a substance that scavenges soils from the wash solution of a laundering operation and said absorber comprises polymers of partially hydrolyzed poly-N-vinyl-$C_1$-$C_3$-carboxamides having a degree of hydrolysis from about 10 mol % to about 50 mol % and a weight average molecular weight from about 40,000 to about 500,000 D, wherein the particulate soil absorber is adhered to the water-insoluble substrate and is effective for inhibiting transfer or redeposition of particulate soil to an item in a wash solution.

2. The laundry article of claim 1, wherein the water-insoluble substrate is fibrous.

3. The laundry article of claim 1, wherein the water-insoluble substrate is selected from the group consisting of cellulosic fibers, modified cellulosic fibers, non-cellulosic fibers, zeolites, starches, modified starches, and mixtures thereof.

4. The laundry article of claim 1, wherein the article further comprises a dye absorber comprising a crosslinked polyamine adhered to a water-insoluble substrate.

5. The laundry article of claim 4, wherein the dye absorber is formed by copolymerizing a bifunctional vinyl or acrylic monomer comprising an amine group with a monomer selected from the group consisting of polyfunctional vinyl compounds, polyfunctional acrylic compounds and mixtures thereof.

6. The laundry article of claim 1, wherein the article further comprises a dye transfer inhibitor releasably attached with the water-insoluble substrate.

7. A method of laundering an item, comprising:

(a) adding a detergent composition to a wash solution;

(b) adding the laundry article as claimed in claim 1 to a wash solution; and (c) laundering an item in the wash solution;

wherein the particulate soil absorber is adhered to the water-insoluble substrate and is effective for inhibiting transfer or redeposition of particulate soil to the item in the wash solution.

8. The method of claim 7, wherein the article further comprises a dye absorber comprising a crosslinked polyamine adhered to the water-insoluble substrate.

9. The method of claim 7, wherein the article further comprises a dye transfer inhibitor releasably attached with the water-insoluble substrate.

10. The laundry article of claim 1, wherein the water-insoluble substrate is selected from the group consisting of cellulosic fibers, modified cellulosic fibers, non-cellulosic fibers and mixtures thereof.

11. The laundry article of claim 1, wherein the particulate soil absorber is adhered to and not releasably attached to the water-insoluble substrate.

12. The laundry article of claim 1, wherein the water-insoluble substrate is impregnated, sprayed, printed or knife coated with said polymers of said soil absorber.

13. The laundry article of claim 1, wherein the water-insoluble substrate is impregnated with a crosslinking agent and said polymers of said soil absorber.

* * * * *